US007586364B2

(12) United States Patent
Fujita et al.

(10) Patent No.: US 7,586,364 B2
(45) Date of Patent: Sep. 8, 2009

(54) POWER SUPPLY VOLTAGE CONTROLLING CIRCUIT AND SEMICONDUCTOR INTEGRATED CIRCUIT

(75) Inventors: Tetsuya Fujita, Kawasaki (JP); Mototsugu Hamada, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 8 days.

(21) Appl. No.: 11/758,343

(22) Filed: Jun. 5, 2007

(65) Prior Publication Data

US 2007/0285152 A1 Dec. 13, 2007

(30) Foreign Application Priority Data

Jun. 12, 2006 (JP) ..... 2006-162089

(51) Int. Cl.
*G05F 1/10* (2006.01)

(52) U.S. Cl. ..... 327/538; 327/543; 323/313; 323/350

(58) Field of Classification Search ..... 327/538–543; 323/265, 266, 268, 269, 271, 272, 282, 284, 323/285, 311–317, 349–351
See application file for complete search history.

(56) References Cited

U.S. PATENT DOCUMENTS 4,906,914 A * 3/1990 Ohsawa ..... 323/314
5,973,484 A * 10/1999 Cho ..... 323/269
6,201,378 B1 * 3/2001 Eto et al. ..... 323/313
6,614,133 B2 9/2003 Belson et al.
6,781,443 B2 * 8/2004 Hamamoto et al. ..... 327/541
6,885,244 B2 * 4/2005 Shor ..... 330/253
6,937,088 B2 * 8/2005 Hamamoto et al. ..... 327/541
7,024,649 B2 4/2006 Collmeyer et al.
7,148,665 B2 * 12/2006 Agari et al. ..... 323/268
7,279,881 B2 * 10/2007 Gerstmeier et al. ..... 323/313

* cited by examiner

*Primary Examiner*—Lincoln Donovan
*Assistant Examiner*—Patrick O'Neill
(74) *Attorney, Agent, or Firm*—Oblon, Spivak, McClelland, Maier & Neustadt, P.C.

(57) ABSTRACT

A power supply voltage controlling circuit has a voltage regulator circuit that supplies a current to an output terminal from at least any of a first power supply and a second power supply, and compares an output voltage at the output terminal with a first reference voltage to adjust the output voltage to approach the first reference voltage; and a controller circuit that supplies the first reference voltage to the voltage regulator circuit and controls the voltage regulator circuit by outputting, to the voltage regulator circuit, at least any of a first enable signal for enabling the first power supply to supply a current to the output terminal and a second enable signal for enabling the second power supply to supply a current to the output terminal.

10 Claims, 5 Drawing Sheets

POWER SUPPLY VOLTAGE CONTROLLING CIRCUIT AND SEMICONDUCTOR INTEGRATED CIRCUIT

CROSS-REFERENCE TO RELATED APPLICATION

This application is based upon and claims the benefit of priority from the prior Japanese Patent Application No. 2006-162089, filed on Jun. 12, 2006, the entire contents of which are incorporated herein by reference.

BACKGROUND OF THE INVENTION

1. Field of the Invention

The present invention relates to a power supply voltage controlling circuit for multiple power supplies and a semiconductor integrated circuit with the power supply voltage controlling circuit.

2. Background Art

There are power supply voltage controlling circuits (power supply voltage regulators) which lower the power supply voltage before supplying the voltage to a logic circuit or the like.

The input voltage of such conventional power supply voltage controlling circuits is set higher in order to allow a margin to derive a stable output voltage from the input voltage that varies significantly. Because of this input voltage margin, the power loss (=((input voltage)−(output voltage))*(input current)) inevitably increases if the input voltage of the power supply voltage controlling circuit is supplied from a single power supply system.

Furthermore, recently, it has become a common practice to lower the set value of the output voltage of the power supply voltage regulator to reduce the power consumption in a situation where the operation can be slowed down. In that situation, if the output voltage is lowered while a high input voltage is used, a considerable power loss occurs.

Thus, some of conventional power supply voltage controlling circuits have a problem that the power loss cannot be suppressed while allowing an input voltage margin to accommodate variations in input voltage, set voltage value or load current.

A conventional power supply voltage controlling circuit has a first power supply circuit that converts a voltage from a direct-current power supply into a first voltage and outputs the first voltage to an output terminal and a second power supply circuit that converts the voltage from the direct-current power supply into a second voltage and outputs the second voltage to the output terminal (see Japanese Patent Laid-Open Publication No. 2004-62331, for example).

This power supply voltage controlling circuit switches between the first power supply circuit and the second power supply circuit, which are different in efficiency, according to the current consumption of a load connected thereto.

However, even according to this conventional technique, the power loss described above can occur if an input voltage margin is allowed, because there is only one power supply system (the direct-current power supply).

SUMMARY OF THE INVENTION

According one aspect of the present invention, there is provided: a power supply voltage controlling circuit that controls an output voltage at an output terminal to a desired set voltage, comprising a voltage regulator circuit that is connected to a first power supply and a second power supply that outputs a higher voltage than said first power supply, supplies a current to said output terminal from at least any of said first power supply and said second power supply, and compares the output voltage at said output terminal with a first reference voltage to adjust said output voltage to approach said first reference voltage; and a controller circuit that supplies said first reference voltage to said voltage regulator circuit and controls said voltage regulator circuit by outputting, to said voltage regulator circuit, at least any of a first enable signal for enabling said first power supply to supply a current to said output terminal and a second enable signal for enabling said second power supply to supply a current to said output terminal.

According another aspect of the present invention, there is provided: a semiconductor integrated circuit, comprising an input/output circuit that is connected to an external device and receives a current from a first power supply; a power supply voltage controlling circuit that controls an output voltage at an output terminal to a desired set voltage, comprising: a voltage regulator circuit that is connected to a first power supply and a second power supply that outputs a higher voltage than said first power supply, supplies a current to said output terminal from at least any of said first power supply and said second power supply, and compares the output voltage at said output terminal with a first reference voltage to adjust said output voltage to approach said first reference voltage; and a controller circuit that supplies said first reference voltage to said voltage regulator circuit and controls said voltage regulator circuit by outputting, to said voltage regulator circuit, at least any of a first enable signal for enabling said first power supply to supply a current to said output terminal and a second enable signal for enabling said second power supply to supply a current to said output terminal; and a logic circuit that is connected to the output terminal of said power supply voltage controlling circuit and receives a current therefrom.

DETAILED DESCRIPTION

Power supply voltage regulators have two essential functions. One is the function of lowering the input voltage to a desired output voltage. The other is the function of reducing variations in output voltage compared with variations in input voltage. As for the function of lowering the input voltage, the output voltage inevitably differs from the input voltage, and therefore, a certain power loss cannot be avoided. However, as for the function of reducing variations in output voltage, the power loss can be reduced by selecting among a plurality of input voltages.

A power supply voltage controlling circuit according to an aspect of the present invention, for example, receives input voltages from two power supply systems of different voltages. For example, if the voltage of a first power supply system decreases, if the load current at the output increases, and the current supplied from the first power supply system becomes insufficient, or if the set voltage at the output is too high, and the voltage of the first power supply system is insufficient, a second power supply system, which has a voltage higher than that of the first power supply system, is used to supply a current to achieve the set voltage at the output. The voltage of the first power supply system is set at a value close to the set voltage at the output in order to reduce the power loss, while the voltage of the second power supply system is set higher than the voltage of the first power supply system. By supplying a current to the output according to the situation, an input voltage margin is allowed to accommodate variations in input voltage, set voltage value at the output or load current, and the power loss is reduced.

In the following, embodiments of the present invention will be described with reference to the drawings.

Embodiment 1

Figure 1:
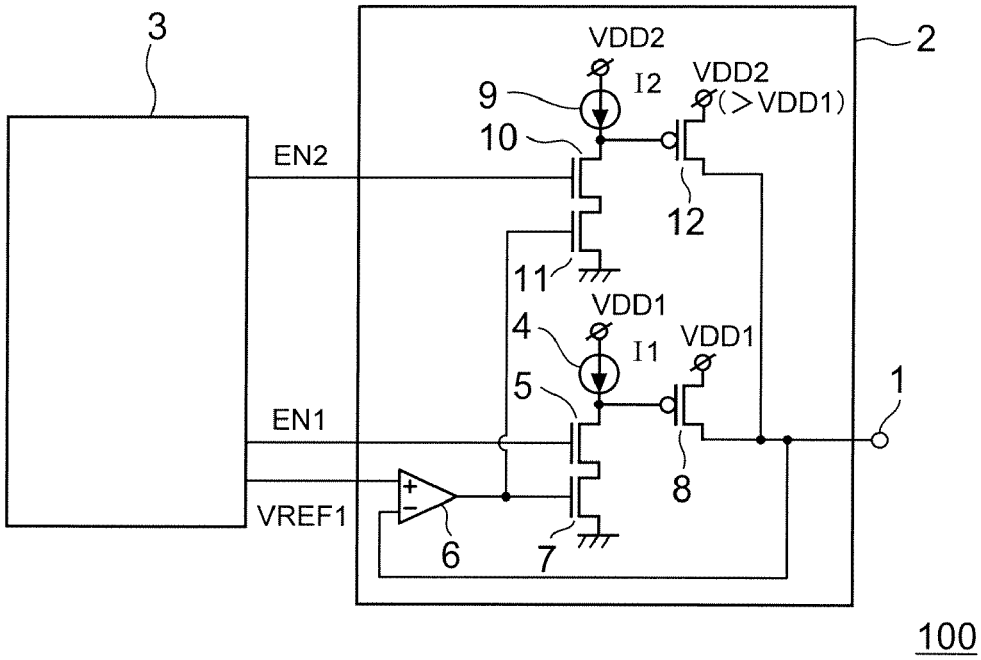
FIG. 1 is a diagram showing a configuration of essential parts of a power supply voltage controlling circuit according to an embodiment 1 of the present invention, which is an aspect of the present invention.

FIG. 1 is a diagram showing a configuration of essential parts of a power supply voltage controlling circuit 100 according to an embodiment 1 of the present invention, which is an aspect of the present invention.

As shown in FIG. 1, the power supply voltage controlling circuit 100 controls the output voltage at an output terminal 1 to a desired set voltage.

The power supply voltage controlling circuit 100 has a voltage regulator circuit 2 connected to a first power supply "VDD1" and a second power supply "VDD2" that outputs a higher voltage than the first power supply and a controller circuit 3 that supplies a first reference voltage "VREF1" to the voltage regulator circuit 2.

The voltage regulator circuit 2 has an operational amplifier 6 that receives the first reference voltage "VREF1" at the non-inverting input terminal and the voltage at the output terminal 1 at the inverting input terminal and outputs a signal based on the inputs.

In addition, the voltage regulator circuit 2 has a first current source 4 connected to the first power supply "VDD1", an n-type MOS transistor 5 that is connected to the first current source 4 and receives a first enable signal "EN1" at the gate thereof, an n-type MOS transistor 7 that is connected between the n-type MOS transistor 5 and a ground potential and receives the output of the operational amplifier 6 at the gate thereof, and a p-type MOS transistor 8 that is connected to the first power supply "VDD1" at the source thereof, to the first current source 4 at the gate thereof and to the output terminal 1 at the drain thereof.

In addition, the voltage regulator circuit 2 has a second current source 9 connected to the second power supply "VDD2", an n-type MOS transistor 10 that is connected to the second current source 9 and receives a second enable signal "EN2" at the gate thereof, an n-type MOS transistor 11 that is connected between the n-type MOS transistor 10 and the ground potential and receives the output of the operational amplifier 6 at the gate thereof, and a p-type MOS transistor 12 that is connected to the second power supply "VDD2" at the source thereof, to the second current source 9 at the gate thereof and to the output terminal 1 at the drain thereof.

The voltage regulator circuit 2 turns on and off the n-type MOS transistors 5 and 10 according to the first and second enable signals "EN1" and "EN2" to control the p-type MOS transistors 8 and 12, thereby supplying a current to the output terminal 1 from at least one of the first power supply "VDD1" and the second power supply "VDD2".

In addition, the operational amplifier 6 in the voltage regulator circuit 2 compares the output voltage at the output terminal 1 with the first reference voltage "VREF1" and outputs a signal representative of the comparison result to the gates of the n-type MOS transistors 7 and 11, thereby adjusting the output voltage to approach the first reference voltage "VREF1".

The controller circuit 3 controls the voltage regulator circuit 2 by outputting at least one of the first enable signal "EN1" for enabling the first power supply "VDD1" to supply a current to the output terminal 1 and the second enable signal "EN2" for enabling the second power supply "VDD2" to supply a current to the output terminal 1 to the voltage regulator circuit 2.

In the case where both the first power supply "VDD1" and the second power supply "VDD2" are selected, priority can be given to the current supply from the first power supply "VDD1" to the output terminal 1 by adjusting the gate width and the gate length of the p-type MOS transistors 8 and 12 and the n-type MOS transistors 5, 7, 10 and 11, and the value of the current flowing through the first current source 4 and the second current source 9.

For example, if the current supply from the first power supply "VDD1" to the output terminal 1 through the p-type MOS transistor 8 becomes inadequate because the voltage of the first power supply "VDD1" decreases, the set first reference voltage "VREF1" increases, or the load current at the output terminal 1 increases, the controller circuit 3 outputs the second enable signal "EN2" to start the current supply from the second power supply "VDD2" to the output terminal 1 through the p-type MOS transistor 12.

In this way, not only the first power supply "VDD1" but also the second power supply "VDD2" is used for supplying a stable output voltage to the output terminal 1. As a result, compared with the conventional power supply controlling circuit that has only one power supply system, and therefore the power supply voltage has to be set higher than necessary, the voltage of the first power supply "VDD1" can be lowered because the voltage margin is not necessary. Therefore, the power loss of the voltage regulator circuit 2 can be reduced.

As described above, the power supply voltage controlling circuit according to this embodiment can supply a current more stably and reduce the power consumption.

Embodiment 2

In the embodiment 1, a configuration of the power supply voltage controlling circuit having the voltage regulator circuit and the controller circuit has been described.

In an embodiment 2, a case where the voltage regulator circuit has another configuration, or more specifically, a case where the voltage regulator circuit has two regulators with different input voltages will be described.

Figure 2:
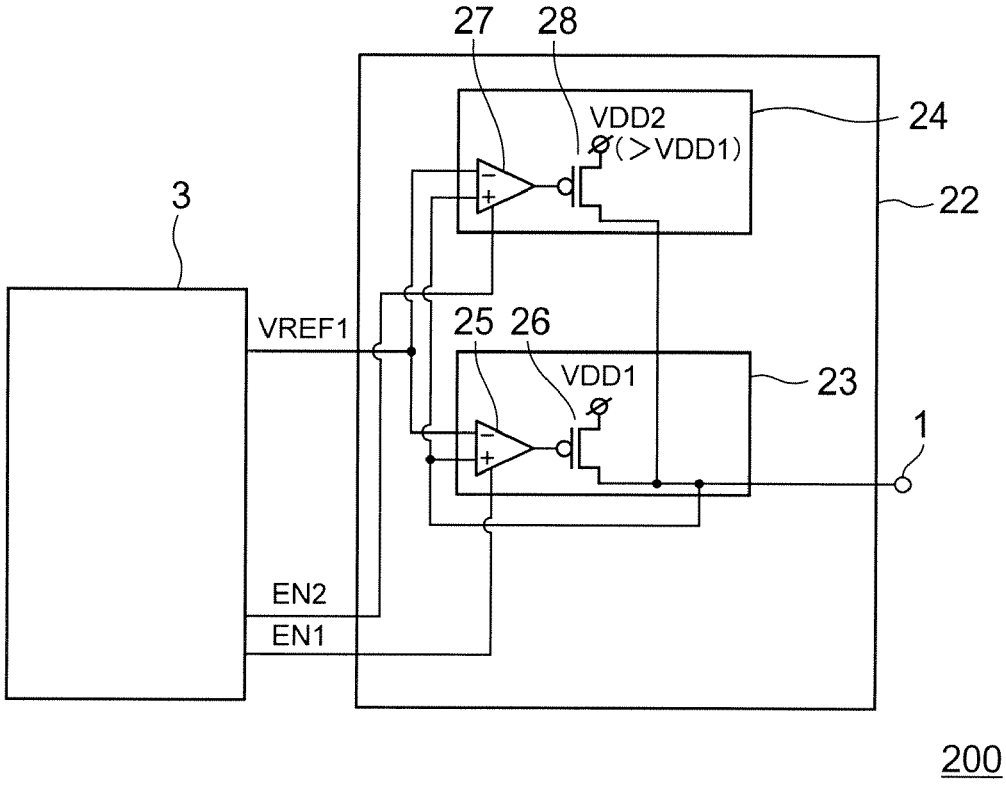
FIG. 2 is a diagram showing a configuration of essential parts of a power supply voltage controlling circuit according to the embodiment 2 of the present invention, which is an aspect of the present invention.

FIG. 2 is a diagram showing a configuration of essential parts of a power supply voltage controlling circuit 200 according to the embodiment 2 of the present invention, which is an aspect of the present invention. In this drawing, the same reference numerals as those in the embodiment 1 denote the same components as those in the embodiment 1.

As shown in FIG. 2, a voltage regulator circuit 22 has a first regulator 23 and a second regulator 24.

The first regulator 23 has an operational amplifier 25 that receives a first reference voltage "VREF1" at the inverting input terminal and the voltage at an output terminal 1 at the non-inverting input terminal and outputs a signal based on the inputs and a p-type MOS transistor 26 that is connected to a first power supply "VDD1" at the source thereof, to the output terminal 1 at the drain thereof and to the output of the operational amplifier 25 at the gate thereof. The operational amplifier 25 is activated by a first enable signal "EN1".

The second regulator 24 has an operational amplifier 27 that receives the first reference voltage "VREF1" at the inverting input terminal and the voltage at the output terminal 1 at the non-inverting input terminal and outputs a signal based on the inputs and a p-type MOS transistor 28 that is connected to a second power supply "VDD2" at the source thereof, to the output terminal 1 at the drain thereof and to the output of the operational amplifier 27 at the gate thereof. The operational amplifier 27 is activated by a second enable signal "EN2".

The voltage regulator circuit 22 activates the operational amplifier 25 and/or the operational amplifier 27 according to the first enable signal "EN1" and the second enable signal "EN2" to control the p-type MOS transistors 26 and 28, thereby supplying a current to the output terminal 1 from at least one of the first power supply "VDD1" and the second power supply "VDD2".

In addition, the operational amplifiers 25 and 27 compare the output voltage at the output terminal 1 with the first reference voltage "VREF1" and outputs a signal representative of the comparison result to the gates of the p-type MOS transistors 26 and 28, thereby adjusting the output voltage to approach the first reference voltage "VREF1".

In the case where both the first power supply "VDD1" and the second power supply "VDD2" are selected, priority can be given to the current supply from the first power supply "VDD1" to the output terminal 1 by adjusting the gate width, the gate length or the like of the p-type MOS transistors 26 and 28.

In this way, the voltage regulator circuit 22 according to this embodiment can operate in the same manner as in the embodiment 1.

As described above, as with the embodiment 1, the power supply voltage controlling circuit according to this embodiment can supply a current more stably and reduce the power consumption.

Embodiment 3

In the embodiment 2, a specific configuration of the voltage regulator circuit has been described.

In an embodiment 3, a specific configuration of the controller circuit will be described. In particular, there will be described an example of the controller circuit that uses the second power supply to supply a current when the voltage of the first power supply decreases.

Figure 3:
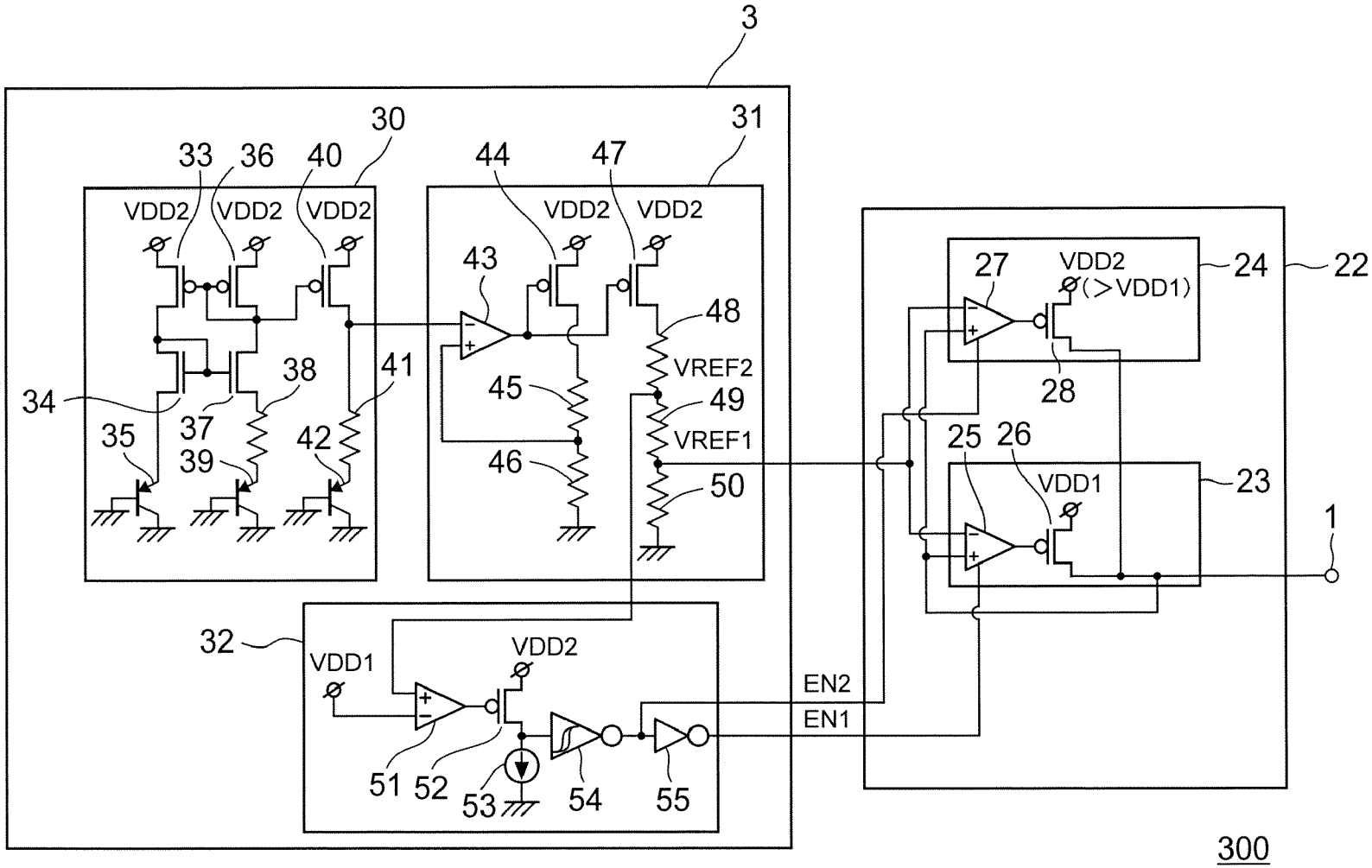
FIG. 3 is a diagram showing a configuration of essential parts of a power supply voltage controlling circuit according to the embodiment 3 of the present invention, which is an aspect of the present invention.

FIG. 3 is a diagram showing a configuration of essential parts of a power supply voltage controlling circuit 300 according to the embodiment 3 of the present invention, which is an aspect of the present invention. In this drawing, the same reference numerals as those in the embodiment 2 denote the same components as those in the embodiment 2.

As shown in FIG. 3, a controller circuit 3 has a constant voltage generating circuit 30 that generates a constant voltage, a reference voltage generating circuit 31 that generates a first reference voltage "VREF1" and a second reference voltage "VREF2", and a regulator selecting circuit 32 that compares the voltage of a first power supply "VDD1" with the second reference voltage "VREF2" and outputs a second enable signal "EN2" if the voltage of the first power supply "VDD1" is lower than the second reference voltage "VREF2".

The constant voltage generating circuit 30 has a p-type MOS transistor 33 connected to a second power supply "VDD2" at the source thereof, an n-type MOS transistor 34 connected to the drain of the p-type MOS transistor 33 at the drain and gate thereof, and a PNP-type bipolar transistor 35 that is connected to the source of the n-type MOS transistor 34 at the emitter thereof and to a ground potential at the base and collector thereof.

In addition, the constant voltage generating circuit 30 has a p-type MOS transistor 36 connected to the second power supply "VDD2" at the source thereof and to the gate of the p-type MOS transistor 33 at the gate and drain thereof, an n-type MOS transistor 37 connected to the drain of the p-type MOS transistor 36 at the drain thereof and to the gate of the n-type MOS transistor 34 at the gate thereof, a resistor 38 connected to the source of the n-type MOS transistor 37, and a PNP-type bipolar transistor 39 connected to the resistor 38 at the emitter thereof and to the ground potential at the base and collector thereof.

In addition, the constant voltage generating circuit 30 has a p-type MOS transistor 40 connected to the second power supply "VDD2" at the source thereof and to the drain of the p-type MOS transistor 36 at the gate thereof, a resistor 41 connected to the drain of the p-type MOS transistor 40, and a PNP-type bipolar transistor 42 connected to the resistor 41 at the emitter thereof and to the ground potential at the base and collector thereof.

The constant voltage generating circuit 30 having the exemplary configuration described above outputs the potential between the p-type MOS transistor 40 and the resistor 41 as the constant voltage.

The reference voltage generating circuit 31 has an operational amplifier 43 that receives the constant voltage at the inverting input terminal, a p-type MOS transistor 44 that is connected to the second power supply "VDD2" at the source thereof and receives the output of the operational amplifier 43 at the gate thereof, a voltage-dividing resistor 45 connected to the drain of the p-type MOS transistor 44, and a voltage-dividing resistor 46 connected between the voltage-dividing resistor 45 and the ground potential.

In addition, the reference voltage generating circuit 31 has a p-type MOS transistor 47 that is connected to the second power supply "VDD2" at the source thereof and receives the output of the operational amplifier 43 at the gate thereof, a voltage-dividing resistor 48 connected to the drain of the p-type MOS transistor 47, a voltage-dividing resistor 49 connected to the voltage-dividing resistor 48, and a voltage-dividing resistor 50 connected between the voltage-dividing resistor 49 and the ground potential.

The reference voltage generating circuit 31 having the exemplary configuration described above outputs the voltage resulting from voltage division at the connection between the resistor 48 and the resistors 49 and 50 as the second reference voltage "VREF2". Besides, the reference voltage generating circuit 31 outputs the voltage resulting from voltage division at the connection between the resistors 48 and 49 and the resistor 50 as the first reference voltage "VREF1".

The regulator selecting circuit 32 has an operational amplifier 51 that receives the second reference voltage "VREF2" at the non-inverting input terminal and the voltage of the first power supply "VDD1" at the inverting input terminal and outputs a signal, a p-type MOS transistor 52 that is connected to the second power supply "VDD2" at the source thereof and receives the output of the operational amplifier 51 at the gate thereof, a constant current source 53 connected between the drain of the p-type MOS transistor 52 and the ground potential, a Schmitt trigger circuit 54 that is connected to the drain of the p-type MOS transistor 52 at the input terminal and outputs a signal inverted from the input signal waveform-shaped, and an inverter 55 that receives the output of the Schmitt trigger circuit 54 and outputs a signal inverted from the received signal.

The regulator selecting circuit 32 outputs the output of the Schmitt trigger circuit 54 to the operational amplifier 27 as the second enable signal "EN2". In addition, the regulator selecting circuit 32 outputs the output of the inverter 55 to the operational amplifier 25 as the first enable signal "EN1".

Therefore, in this embodiment, the second enable signal "EN2" is a signal inverted from the first enable signal "EN1". As a result, in this embodiment, when the operational amplifier 25 is active, the operational amplifier 27 is inactive. When the operational amplifier 27 is active, the operational amplifier 25 is inactive.

The operational amplifier 51 compares the voltage of the first power supply "VDD1" with the second reference voltage "VREF2" to control the p-type MOS transistor 52. Consequently, the input voltage of the Schmitt trigger circuit 54 is controlled. In this way, the Schmitt trigger circuit 54 controls the output second enable signal "EN2" according to the value of the voltage of the first power supply "VDD1". For example, when the voltage of the first power supply "VDD1" is lower than the second reference voltage "VREF2", the Schmitt trigger circuit 54 outputs the second enable signal.

In this way, the regulator selecting circuit 32 detects a decrease in voltage of the first power supply "VDD1", stops the current supply from the first power supply "VDD1" to an output terminal 1, and starts the current supply from the second power supply "VDD2" to the output terminal 1.

Since the second power supply "VDD2" covers the deficiency in voltage at the output terminal 1, the voltage margin to accommodate the decrease in voltage of the first power supply "VDD1" can be reduced. In other words, the difference between the input voltage from the first power supply "VDD1" and the output voltage at the output terminal 1 can be reduced, and therefore, the power loss of the voltage regulator circuit can be reduced.

As described above, the power supply voltage controlling circuit according to this embodiment can supply a current more stably and reduce the power consumption.

Embodiment 4

In the embodiment 3, a specific configuration of the controller circuit has been described.

In an embodiment 4, there will be described another configuration of the controller circuit that differs from the above-described one in configuration of the reference voltage generating circuit. According to this embodiment, in particular, the second power supply is used to supply a current when the set value of the output voltage is high.

Figure 4:
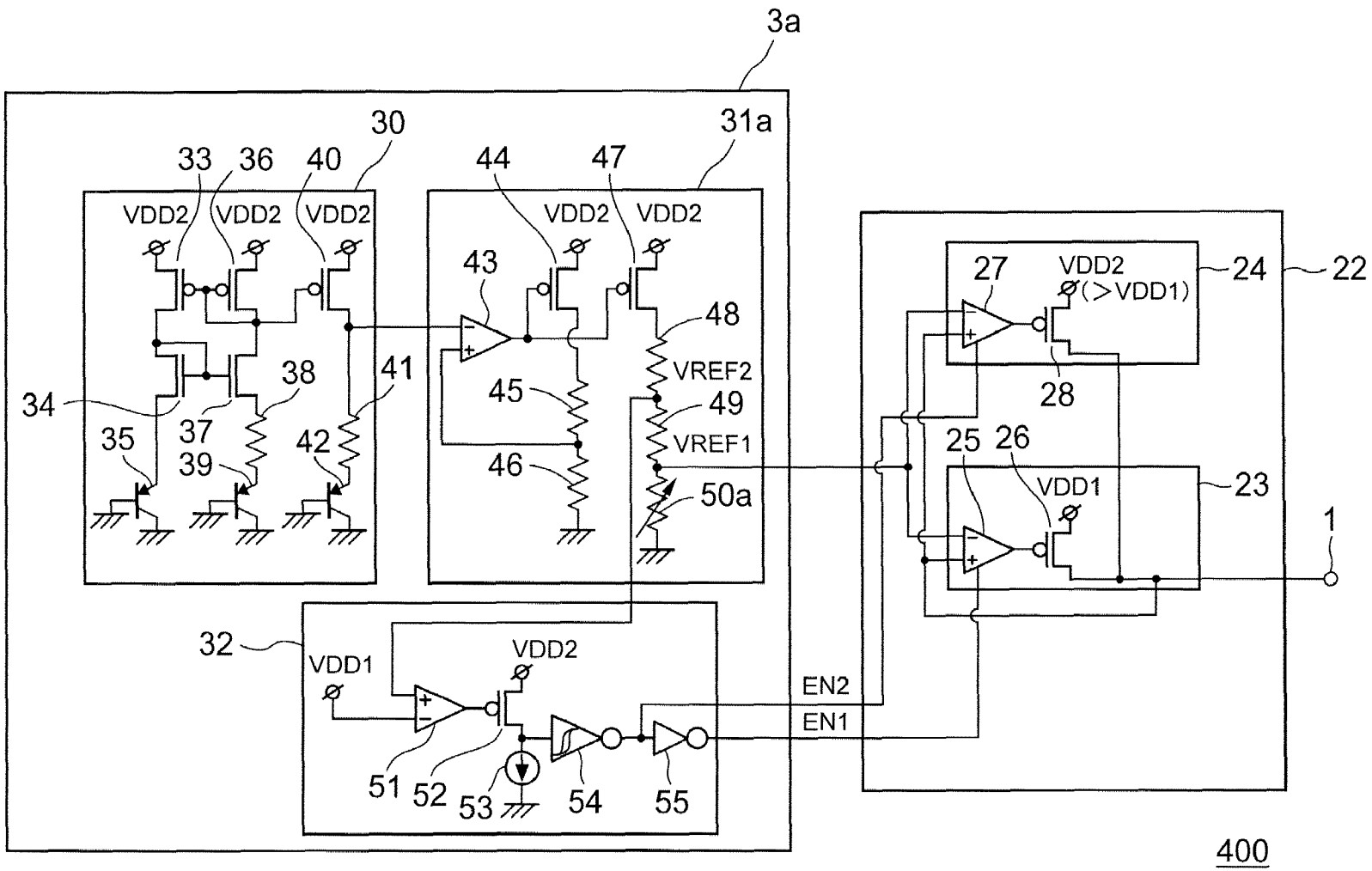
FIG. 4 is a diagram showing a configuration of essential parts of a power supply voltage controlling circuit according to the embodiment 4 of the present invention, which is an aspect of the present invention.

FIG. 4 is a diagram showing a configuration of essential parts of a power supply voltage controlling circuit 400 according to the embodiment 4 of the present invention, which is an aspect of the present invention. In this drawing, the same reference numerals as those in the embodiment 3 denote the same components as those in the embodiment 3.

As shown in FIG. 4, a reference voltage generating circuit 31*a* has an operational amplifier 43 that receives the constant voltage at the inverting input terminal, a p-type MOS transistor 44 that is connected to a second power supply "VDD2" at the source thereof and receives the output of the operational amplifier 43 at the gate thereof, a voltage-dividing resistor 45 connected to the drain of the p-type MOS transistor 44, and a voltage-dividing resistor 46 connected between the voltage-dividing resistor 45 and a ground potential.

In addition, the reference voltage generating circuit 31*a* has a p-type MOS transistor 47 that is connected to the second power supply "VDD2" at the source thereof and receives the output of the operational amplifier 43 at the gate thereof, a voltage-dividing resistor 48 connected to the drain of the p-type MOS transistor 47, and a voltage-dividing variable resistor 50*a* connected between the voltage-dividing resistor 49 and the ground potential.

The reference voltage generating circuit 31*a* adjusts the resistance value of the voltage-dividing resistor 50*a*, thereby changing the voltage division ratio of the voltage-dividing circuit constituted by the voltage-dividing resistors 48, 49 and 50*a*, thereby adjusting a first reference voltage "VREF1". The reference voltage generating circuit 31*a* adjusts a second reference voltage "VREF2" in the same manner.

For example, when there are a plurality of set values of the output voltage at an output terminal 1, and a higher one is selected from among the set values, the resistance value of the voltage-dividing resistor 50*a* is raised. As a result, the first reference voltage "VREF1" and the second reference voltage "VREF2" are raised.

Then, as described above, the regulator selecting circuit 32 determines whether or not the first power supply "VDD1" can supply a sufficient current to the output terminal 1. If the first power supply "VDD1" is inadequate as a power supply (if the voltage of the first power supply "VDD1" is lower than the second reference voltage "VREF2", for example), the regulator selecting circuit 32 stops the current supply from the first power supply "VDD1" to the output terminal 1 and starts the current supply from the second power supply "VDD2" to the output terminal 1 (that is, outputs a second enable signal). In this way, the output voltage can be maintained at the desired set value.

In this way, the mechanism for determining whether the first power supply "VDD1", which supplies a lower voltage, can supply a sufficient output voltage or not allows selection of a power supply with a lower power loss and reduction in power consumption.

As described above, the power supply voltage controlling circuit according to this embodiment can supply a current more stably and reduce the power consumption.

Embodiment 5

In the embodiment 3, a specific configuration of the controller circuit has been described.

In an embodiment 5, there will be described a configuration of the controller circuit that further has a detecting circuit that detects an increase in load current so that the second power supply can also be used for supplying a current to the output terminal when the load current increases.

Figure 5:
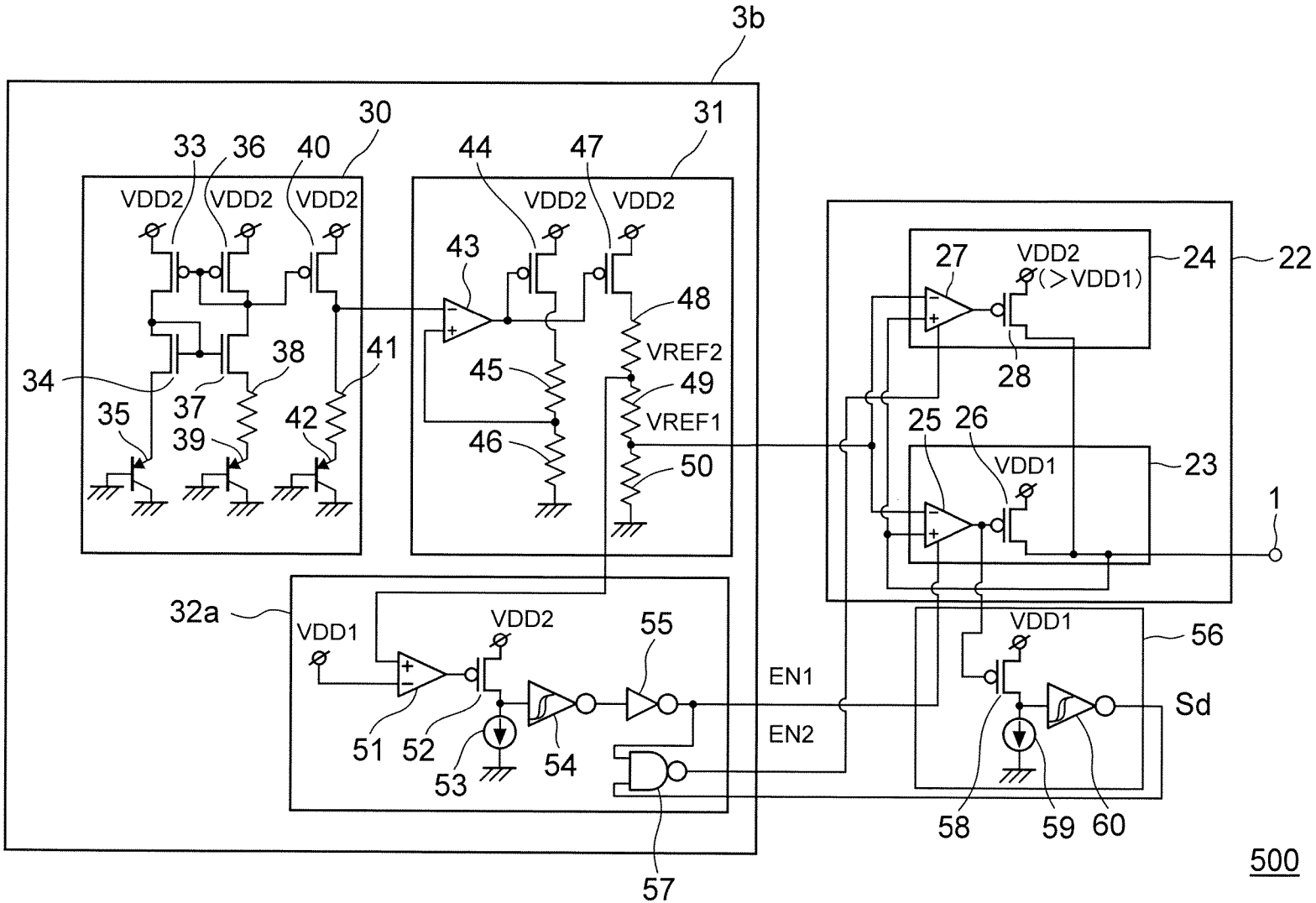
FIG. 5 is a diagram showing a configuration of essential parts of a power supply voltage controlling circuit according to the embodiment 5 of the present invention, which is an aspect of the present invention.

FIG. 5 is a diagram showing a configuration of essential parts of a power supply voltage controlling circuit 500 according to the embodiment 5 of the present invention, which is an aspect of the present invention. In this drawing, the same reference numerals as those in the embodiment 3 denote the same components as those in the embodiment 3.

As shown in FIG. 5, a power supply voltage controlling circuit 500 further has a detecting circuit 56 for detecting a load current at an output terminal 1.

The detecting circuit 56 has a p-type MOS transistor 58 connected to a first power supply "VDD1" at the source thereof and to the output of an operational amplifier 25 at the gate thereof, a current source 59 connected between the drain of the p-type MOS transistor 58 and a ground potential, and a Schmitt trigger circuit 60 connected to the drain of the p-type MOS transistor 58 at the input thereof and to a regulator selecting circuit 32*a* at the output thereof.

The detecting circuit 56 indirectly detects an increase in load current when a p-type MOS transistor 26 is turned on according to the output of the operational amplifier 25. Specifically, for example, when the p-type MOS transistor 26 is turned on, the p-type MOS transistor 58 is also turned on according to the output of the operational amplifier 25, causing the voltage input to the Schmitt trigger circuit 60 to rise. In response to this voltage rise, the output of the Schmitt trigger circuit 60 (a detection signal "Sd") changes from a signal "1" to a signal "0".

The regulator selecting circuit 32*a* has an operational amplifier 51 that receives a second reference voltage "VREF2" at the non-inverting input terminal and the voltage of the first power supply "VDD1" at the inverting input terminal and outputs a signal, a p-type MOS transistor 52 that is connected to a second power supply "VDD2" at the source thereof, and receives the output of the operational amplifier 51 at the gate thereof, a constant current source 53 connected between the drain of the p-type MOS transistor 52 and the ground potential, a Schmitt trigger circuit 54 that is connected to the drain of the p-type MOS transistor 52 at the input terminal thereof and outputs a signal inverted from the input signal waveform-shaped, an inverter 55 that receives the output of the Schmitt trigger circuit 54 and outputs a signal inverted from the received signal, and an NAND circuit 57 that receives the output of the Schmitt trigger circuit 60 and the output of the inverter 55.

The regulator selecting circuit 32*a* outputs the output of the NAND circuit 57 to an operational amplifier 27 as a second enable signal "EN2". Besides, the regulator selecting circuit 32*a* outputs the output of the inverter 55 as a first enable signal "EN1".

In this embodiment, even when the inverter 55 is outputting the first enable signal "EN1" (signal "1"), the NAND circuit 57 outputs the second enable signal "EN2" (signal "1") if the output of the Schmitt trigger circuit 60 (detection signal "Sd") is the signal "0". Therefore, in this embodiment, the operational amplifier 27 can be active even when the operational amplifier 25 is active.

When the operational amplifier 25 is inactive, the inverter 55 outputs the signal "0", so that the NAND circuit 57 outputs the second enable signal (signal "1"), and therefore, the operational amplifier 27 is active.

The activated operational amplifiers 25 and 27 control the p-type MOS transistors 26 and 28 to supply a current from the first power supply "VDD1" and the second power supply "VDD2" to the output terminal 1 via a first regulator 23 and a second regulator 24.

In this way, if the detecting circuit 56 detects an increase in load current when a voltage regulator circuit 22 is supplying a current from the first power supply "VDD1" to the output terminal 1, the detecting circuit 56 outputs the detection signal "Sd" to a controller circuit 3*b* (regulator selecting circuit 32*a*) to make it output the second enable signal "EN2".

As described above, the power supply voltage controlling circuit 500 detects an increase in load current during current supply from the first power supply "VDD1" to the output terminal 1 based on the gate voltage of the p-type MOS transistor 58. Based on the detection result, the power supply voltage controlling circuit 500 additionally uses the second power supply "VDD2" to supply a current to the output terminal 1, thereby preventing the output voltage from being reduced when the load current increases.

As described above, the power supply voltage controlling circuit according to this embodiment can supply a current more stably and reduce the power consumption.

Embodiment 6

In general, many semiconductor integrated circuits have two or more power supply systems of different voltages. And, power supply voltage controlling circuits are seldom prohibited from having two power supply voltages. For example, there is a power supply voltage controlling circuit that has an I/O power supply of 2.5 V±0.2 V and a core power supply of 1.2 V±0.1 V.

In an embodiment 6, there will be described a configuration of a semiconductor integrated circuit to which the power supply voltage controlling circuit 100 according to the embodiment 1 is applied. However, the power supply voltage controlling circuits 200 to 500 according to the other embodiments can equally be applied to semiconductor integrated circuits.

Figure 6:
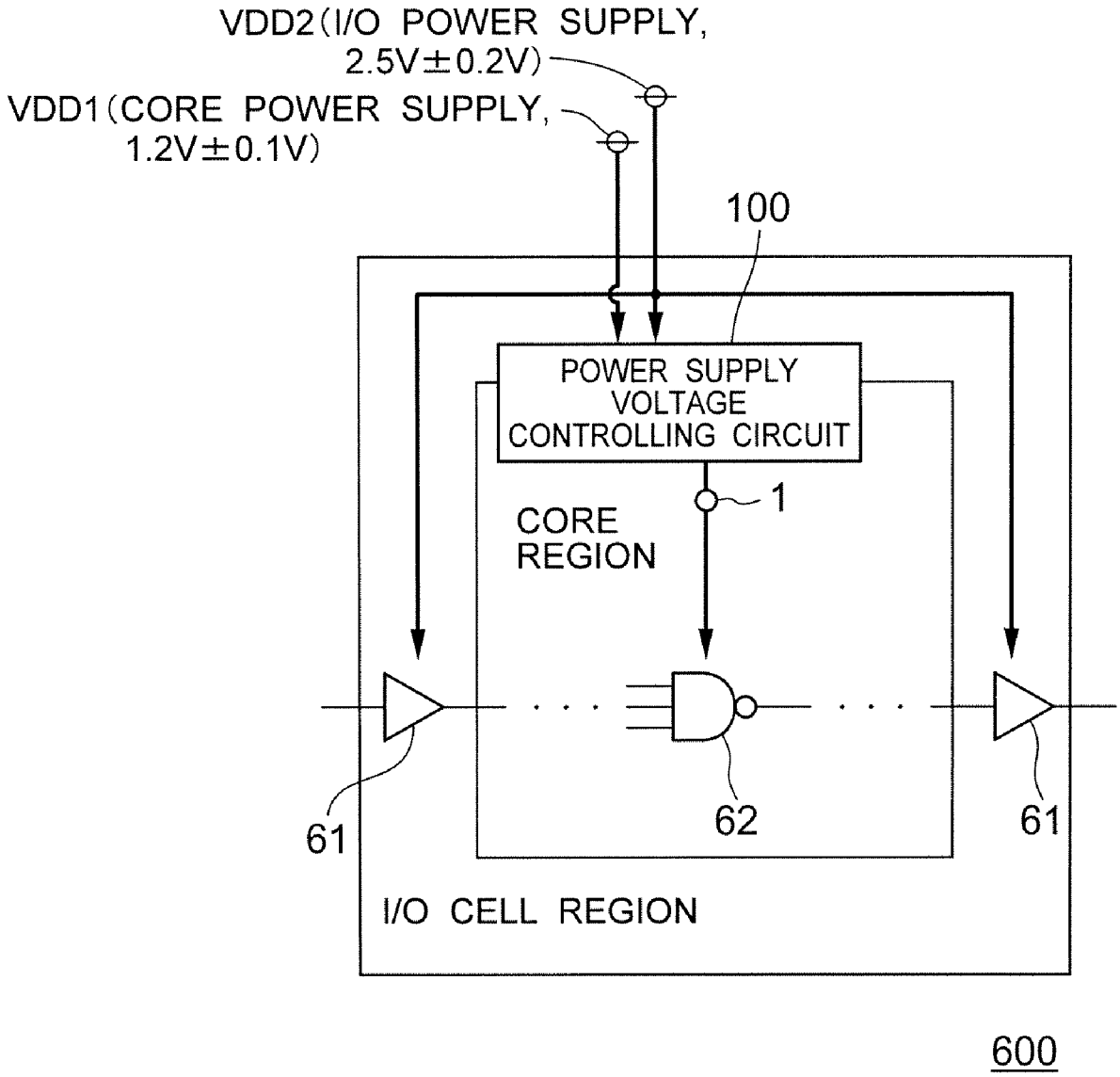
FIG. 6 is a diagram showing a configuration of essential parts of a semiconductor integrated circuit according to the embodiment 6, which is an aspect of the present invention.

FIG. 6 is a diagram showing a configuration of essential parts of a semiconductor integrated circuit 600 according to the embodiment 6, which is an aspect of the present invention. In this drawing, the same reference numerals as those in the embodiment 1 denote the same components as those in the embodiment 1.

As shown in FIG. 6, the semiconductor integrated circuit 600 has an input/output circuit 61, such as an input/output buffer, that is connected to an external device (not shown) and receives a current supplied from a first power supply "VDD1", a power supply voltage controlling circuit 100 that controls the output voltage at an output terminal 1 to a desired set voltage, and a logic circuit 62 that is connected to the output terminal 1 of the power supply voltage controlling circuit 100 to receive a current.

In the case where a conventional power supply voltage regulator is used for a regulated power supply of 1.1 V±0.05 V, it is difficult to generate a stable output voltage of 1.1 V±0.05 V because of the lower limit of the voltage of the core power supply of 1.1 V and the high load current. Allowing for a voltage margin, the output voltage of 1.1 V±0.05 V has to be generated by the I/O power supply of 2.5 V±0.2 V. In this case, the power loss due to the input/output difference reaches to 50 to 61%.

However, the semiconductor integrated circuit 600, which incorporates the power supply voltage controlling circuit 100, generates the output voltage of 1.1 V±0.05 V using the first power supply "VDD1" (core power supply of 1.2 V±0.1 V) and the second power supply "VDD2" (I/O power supply of 2.5 V±0.2 V).

In this case, the power loss due to the input/output difference is 19 to 61%. Since the range in which the semiconductor integrated circuit can be used with low power loss is expanded, the power consumption is reduced.

Furthermore, in the case where a conventional power supply voltage regulator lowers the voltage of the I/O power supply of 2.5 V±0.2 V to two set voltages of 1.1 V±0.05 V and 0.9 V±0.05 V, the power loss due to the input/output difference reaches to 50 to 68%.

However, the semiconductor integrated circuit 600, which incorporates the power supply voltage controlling circuit 100, generates stable output voltages of 1.1 V±0.05 V and 0.9 V±0.05 V using the first power supply "VDD1" (core power supply of 1.2 V±0.1 V) and the second power supply "VDD2" (I/O power supply of 2.5 V±0.2 V).

In this case, the power loss due to the input/output difference is 13 to 61%. The first power supply "VDD1" (core power supply of 1.2 V±0.1 V) is used to generate the voltage of 0.9 V±0.05 V. When generating the voltage of 1.1 V±0.05 V, the second power supply "VDD2" (I/O power supply of 2.5 V±0.2 V) is also used only if the voltage of the first power supply "VDD1" (core power supply of 1.2 V±0.1 V) decreases to 1.1 V, and the load current is high. As a result, occurrence of a situation in which the power loss reaches to 61% is limited. Thus, the power consumption is further reduced.

As described above, the semiconductor integrated circuit according to this embodiment can supply a current more stably and reduce the power consumption.

In the embodiments described above, MOS transistors are used. However, the same effects and advantages can be provided using bipolar transistors.

Even if the polarity of the MOS transistors in the embodiments described above is inverted, the same effects and advantages can be provided by inverting the polarity of the whole circuit.

What is claimed is:

1. A power supply voltage controlling circuit that controls an output voltage at an output terminal to a desired set voltage, comprising:

a voltage regulator circuit that is connected to a first power supply and a second power supply that outputs a higher voltage than said first power supply, supplies a current to said output terminal from at least any of said first power supply and said second power supply, and compares the output voltage at said output terminal with a first reference voltage to adjust said output voltage to approach said first reference voltage; and a controller circuit that supplies said first reference voltage to said voltage regulator circuit and controls said voltage regulator circuit by outputting, to said voltage regulator circuit, at least any of a first enable signal for enabling said first power supply to supply a current to said output terminal and a second enable signal for enabling said second power supply to supply a current to said output terminal, wherein said controller circuit has a regulator selecting circuit that compares the voltage of said first power supply with a second reference voltage and outputs said second enable signal if the voltage of said first power supply is lower than said second reference voltage.

2. The power supply voltage controlling circuit according to claim 1, wherein said controller circuit has a reference voltage generating circuit that generates said first reference voltage and adjusts the first reference voltage.

3. The power supply voltage controlling circuit according to claim 1, further comprising:

a detecting circuit that detects a load current flowing through said output terminal, wherein said detecting circuit outputs a detection signal that makes said controller circuit output said second enable signal if said detecting circuit detects an increase in said load current while said voltage regulator circuit is supplying a current to said output terminal from said first power supply.

4. A power supply voltage controlling circuit that controls an output voltage at an output terminal to a desired set voltage, comprising:

a voltage regulator circuit that is connected to a first power supply and a second power supply that outputs a higher voltage than said first power supply, supplies a current to said output terminal from at least any of said first power supply and said second power supply, and compares the output voltage at said output terminal with a first reference voltage to adjust said output voltage to approach said first reference voltage;

a controller circuit that supplies said first reference voltage to said voltage regulator circuit and controls said voltage regulator circuit by outputting, to said voltage regulator circuit, at least any of a first enable signal for enabling said first power supply to supply a current to said output terminal and a second enable signal for enabling said second power supply to supply a current to said output terminal, and a detecting circuit that detects a load current flowing through said output terminal, wherein said detecting circuit outputs a detection signal that makes said controller circuit output said second enable signal if said detecting circuit detects an increase in said load current while said voltage regulator circuit is supplying a current to said output terminal from said first power supply.

5. A power supply voltage controlling circuit that controls an output voltage at an output terminal to a desired set voltage, comprising:

a voltage regulator circuit that is connected to a first power supply and a second power supply that outputs a higher voltage than said first power supply, supplies a current to said output terminal from at least any of said first power supply and said second power supply, and compares the output voltage at said output terminal with a first reference voltage to adjust said output voltage to approach said first reference voltage;

a controller circuit that supplies said first reference voltage to said voltage regulator circuit and controls said voltage regulator circuit by outputting, to said voltage regulator circuit, at least any of a first enable signal for enabling said first power supply to supply a current to said output terminal and a second enable signal for enabling said second power supply to supply a current to said output terminal, and a detecting circuit that detects a load current flowing through said output terminal, wherein said controller circuit has a reference voltage generating circuit that generates said first reference voltage and adjusts the first reference voltage, and wherein said detecting circuit outputs a detection signal that makes said controller circuit output said second enable signal if said detecting circuit detects an increase in said load current while said voltage regulator circuit is supplying a current to said output terminal from said first power supply.

6. A semiconductor integrated circuit, comprising:

an input/output circuit that is connected to an external device and receives a current from a first power supply;

a power supply voltage controlling circuit that controls an output voltage at an output terminal to a desired set voltage, comprising: a voltage regulator circuit that is connected to a first power supply and a second power supply that outputs a higher voltage than said first power supply, supplies a current to said output terminal from at least any of said first power supply and said second power supply, and compares the output voltage at said output terminal with a first reference voltage to adjust said output voltage to approach said first reference voltage; and a controller circuit that supplies said first reference voltage to said voltage regulator circuit and controls said voltage regulator circuit by outputting, to said voltage regulator circuit, at least any of a first enable signal for enabling said first power supply to supply a current to said output terminal and a second enable signal for enabling said second power supply to supply a current to said output terminal; and a logic circuit that is connected to the output terminal of said power supply voltage controlling circuit and receives a current therefrom, wherein said controller circuit has a regulator selecting circuit that compares the voltage of said first power supply with a second reference voltage and outputs said second enable signal if the voltage of said first power supply is lower than said second reference voltage.

7. The semiconductor integrated circuit according to claim 6, wherein said controller circuit has a reference voltage generating circuit that generates said first reference voltage and adjusts the first reference voltage.

8. The semiconductor integrated circuit according to claim 6, wherein said power supply voltage controlling circuit further comprising:

a detecting circuit that detects a load current flowing through said output terminal, wherein said detecting circuit outputs a detection signal that makes said controller circuit output said second enable signal if said detecting circuit detects an increase in said load current while said voltage regulator circuit is supplying a current to said output terminal from said first power supply.

9. A semiconductor integrated circuit, comprising:

an input/output circuit that is connected to an external device and receives a current from a first power supply;

a power supply voltage controlling circuit that controls an output voltage at an output terminal to a desired set voltage, comprising: a voltage regulator circuit that is connected to a first power supply and a second power supply that outputs a higher voltage than said first power supply, supplies a current to said output terminal from at least any of said first power supply and said second power supply, and compares the output voltage at said output terminal with a first reference voltage to adjust said output voltage to approach said first reference voltage; and a controller circuit that supplies said first reference voltage to said voltage regulator circuit and controls said voltage regulator circuit by outputting, to said voltage regulator circuit, at least any of a first enable signal for enabling said first power supply to supply a current to said output terminal and a second enable signal for enabling said second power supply to supply a current to said output terminal; and a logic circuit that is connected to the output terminal of said power supply voltage controlling circuit and receives a current therefrom, wherein said power supply voltage controlling circuit further comprising:

a detecting circuit that detects a load current flowing through said output terminal, wherein said detecting circuit outputs a detection signal that makes said controller circuit output said second enable signal if said detecting circuit detects an increase in said load current while said voltage regulator circuit is supplying a current to said output terminal from said first power supply.

10. A semiconductor integrated circuit, comprising:

an input/output circuit that is connected to an external device and receives a current from a first power supply;

a power supply voltage controlling circuit that controls an output voltage at an output terminal to a desired set voltage, comprising: a voltage regulator circuit that is connected to a first power supply and a second power supply that outputs a higher voltage than said first power supply, supplies a current to said output terminal from at least any of said first power supply and said second power supply, and compares the output voltage at said output terminal with a first reference voltage to adjust said output voltage to approach said first reference voltage; and a controller circuit that supplies said first reference voltage to said voltage regulator circuit and controls said voltage regulator circuit by outputting, to said voltage regulator circuit, at least any of a first enable signal for enabling said first power supply to supply a current to said output terminal and a second enable signal for enabling said second power supply to supply a current to said output terminal; and a logic circuit that is connected to the output terminal of said power supply voltage controlling circuit and receives a current therefrom, wherein said controller circuit as a reference voltage generating circuit that generates said first reference voltage and adjusts the first reference voltage, and wherein said power supply voltage controlling circuit further comprising:

a detecting circuit that detects a load current flowing through said output terminal, wherein said detecting circuit outputs a detection signal that makes said controller circuit output said second enable signal if said detecting circuit detects an increase in said load current while said voltage regulator circuit is supplying a current to said output terminal from said first power supply.

* * * * *